US010363187B2

(12) United States Patent
Sineath, Jr. et al.

(10) Patent No.: US 10,363,187 B2
(45) Date of Patent: Jul. 30, 2019

(54) METHODS AND APPARATUS FOR MOVING A PATIENT FROM A RECLINING POSITION TO AN UPRIGHT SITTING POSITION

(71) Applicants: James V. Sineath, Jr., Burlington, NC (US); Mark R. Cervi, Greenville, NC (US)

(72) Inventors: James V. Sineath, Jr., Burlington, NC (US); Mark R. Cervi, Greenville, NC (US)

(73) Assignee: CNS Solutions, LLC, Greenville, NC (US)

( * ) Notice: Subject to any disclaimer, the term of this patent is extended or adjusted under 35 U.S.C. 154(b) by 510 days.

(21) Appl. No.: 15/245,814

(22) Filed: Aug. 24, 2016

(65) Prior Publication Data

US 2018/0055705 A1 Mar. 1, 2018

(51) Int. Cl.
*A61G 7/10* (2006.01)
*A61G 7/16* (2006.01)

(52) U.S. Cl.
CPC ..... *A61G 7/1007* (2013.01); *A61G 7/1017* (2013.01); *A61G 7/1019* (2013.01);
(Continued)

(58) Field of Classification Search
CPC .. A61G 7/1046; A61G 7/1049; A61G 7/1059; A61G 7/16; A61G 7/1086;
(Continued)

(56) References Cited

U.S. PATENT DOCUMENTS 787,760 A * 4/1905 Higgins ..... A61G 7/1055 212/345
2,152,431 A * 3/1939 Jensen ..... A61H 1/02 601/26

(Continued)

FOREIGN PATENT DOCUMENTS

GB 2 381 256 A 4/2003
WO WO 2014/029988 A1 2/2014

OTHER PUBLICATIONS

International Search Report and Written Opinion of the International Searching Authority, International Application No. PCT/US2017/042985, dated Oct. 16, 2017.

*Primary Examiner* — Robert G Santos
(74) *Attorney, Agent, or Firm* — Myers Bigel, P.A.

(57) ABSTRACT

An apparatus for moving a patient from a reclining position to an upright sitting position, and methods of using same, are described. The apparatus includes an articulating patient support platform with first, second and third panels. The first panel includes opposite first and second ends and the second panel is movably attached to the first panel first end and is upwardly pivotable from a substantially co-planar relationship with the first panel to a substantially orthogonal relationship with the first panel. The third panel is secured to the second panel in spaced-apart, substantially co-planar relationship therewith. A patient is positioned on the patient support platform with the patient's upper body supported by the first and second panels and the patient's legs supported by the third panel. The second panel is caused to pivot upwardly, thereby moving the patient to a generally upright sitting position.

26 Claims, 11 Drawing Sheets

(52) U.S. Cl.
CPC ..... *A61G 7/1046* (2013.01); *A61G 7/1059* (2013.01); *A61G 7/1063* (2013.01); *A61G 7/1088* (2013.01); *A61G 7/16* (2013.01); *A61G 2203/12* (2013.01)

(58) Field of Classification Search
CPC ..... A61G 7/1088; A61G 7/109; A61G 13/12; A61G 13/1225; A61G 13/1245; A61G 7/1013; A61G 7/1019; A61G 7/002; A61G 7/005; A61G 7/012; A61G 7/015; A61G 7/018; A61G 7/02; A61G 13/02; A61G 13/04; A61G 13/06; A61G 13/08; A61G 7/1007
USPC ..... 5/86.1, 83.1, 81.1 R, 613, 616–618, 611, 5/11, 604, 600
See application file for complete search history.

(56) References Cited

U.S. PATENT DOCUMENTS 2,869,614 A * 1/1959 Wamsley ..... A61G 5/006 280/211
3,050,741 A * 8/1962 Coleman ..... A61G 7/02 108/36
3,095,235 A 6/1963 Babcock et al.
4,119,342 A 10/1978 Jones
4,920,587 A * 5/1990 Kerr ..... A47K 11/02 4/480
4,928,332 A * 5/1990 Ogden ..... A47C 20/048 5/308
5,040,253 A * 8/1991 Cheng ..... A47C 17/16 5/616
5,062,165 A * 11/1991 Kerr ..... A61G 7/1007 4/480
5,282,835 A * 2/1994 Wright ..... A61H 1/0292 5/613
5,468,216 A * 11/1995 Johnson ..... A61H 1/0292 5/616
5,787,528 A * 8/1998 Antinori ..... A47C 20/041 318/16
5,916,085 A 6/1999 Wells
6,289,536 B1 9/2001 Betson
6,502,264 B1 * 1/2003 Clothier ..... A47C 20/041 368/12
6,945,604 B2 9/2005 Splane, Jr.
7,237,286 B1 * 7/2007 Kim ..... A47C 20/041 5/613
7,461,420 B2 * 12/2008 Kim ..... A47C 20/041 5/613
8,156,581 B2 4/2012 Fogleman
8,544,866 B2 10/2013 Noonan et al.
8,898,838 B1 12/2014 Tu
8,997,274 B2 * 4/2015 Phillips ..... A47C 1/0242 5/37.1
9,072,643 B2 7/2015 Hines
9,265,677 B2 2/2016 Manouchehri et al.
2004/0019967 A1 2/2004 Gant
2007/0124859 A1 6/2007 Stryker et al.
2007/0169266 A1 * 7/2007 Kim ..... A47C 20/041 5/607
2007/0251009 A1 * 11/2007 Kim ..... A47C 20/041 5/618
2009/0094745 A1 4/2009 Benzo et al.
2011/0009903 A1 1/2011 Estrada
2014/0203608 A1 * 7/2014 Phillips ..... A47C 1/0242 297/330
2018/0055705 A1 * 3/2018 Sineath, Jr. ..... A61G 7/1007

* cited by examiner

METHODS AND APPARATUS FOR MOVING A PATIENT FROM A RECLINING POSITION TO AN UPRIGHT SITTING POSITION

FIELD OF THE INVENTION

The present invention relates generally to patient handling and, more specifically, to methods and apparatus for lifting and transporting patients.

BACKGROUND

Persons with certain disabilities may have difficulty moving from a reclining position in bed to an upright sitting position. Often, such patients are manually lifted to a sitting position by a nurse or care giver. Unfortunately, manually lifting or otherwise moving a patient can hurt the patient by causing bruises, tearing skin, etc. Beds that can be converted into chair-like configurations that can assist patients in moving from a reclining position to a sitting position for the purpose of achieving a standing or walking position have been developed. However, alternative more economical devices are still needed.

SUMMARY

According to some embodiments of the present invention, an apparatus for moving a patient between a reclining position on a bed and a generally upright sitting position includes a base, a lifting mechanism (e.g., a manual, electric, hydraulic, or pneumatic lifting mechanism) secured to the base, and an articulating patient support platform secured to the lifting mechanism. The patient support platform is movable via the lifting mechanism between raised and lowered generally horizontal positions. In some embodiments, a control system or unit with user controls is provided that operates the lifting mechanism to move the patient support platform between various raised and lowered positions.

The patient support platform includes first, second and third panels, each having a generally planar, rectangular configuration. The first panel is secured to the lifting mechanism and includes opposite first and second ends and the second panel is movably attached to the first panel first end and is upwardly pivotable from a substantially co-planar relationship with the first panel to a substantially orthogonal relationship with the first panel. The third panel is secured to the second panel in spaced-apart, substantially co-planar relationship therewith. The patient support platform is positionable on the bed such that a patient lying on the bed can be moved onto the patient support platform and positioned such that the patient's upper body is supported by the first and second panels and the patient's legs are supported by the third panel. The weight of the patient's legs on the third panel causes the third panel to move under the force of gravity and pivot the second panel upwardly such that the patient is moved to a generally upright sitting position.

In some embodiments, a fourth panel is movably attached to the first panel second end and is upwardly pivotable (e.g., manually or via an actuator) from a substantially co-planar relationship with the first panel to a substantially orthogonal relationship with the first panel. When the second and fourth panels are substantially orthogonal to the first panel, a patient in an upright sitting position on the first panel can be protected on both sides and prevented from falling to either side.

In some embodiments, the third panel is configured to be removable from the second panel and is configured to be removably secured to the fourth panel. This allows for the apparatus to be used on either side of a bed and/or when a patient is lying on a bed with his/her head at either end of the bed. When the third panel is removably secured to the fourth panel, the patient support platform is positionable on a bed such that a patient lying on the bed can be moved onto the patient support platform and positioned such that the patient's upper body is supported by the first and fourth panels and the patient's legs are supported by the third panel. The weight of the patient's legs on the third panel causes the third panel to move under the force of gravity and pivot the fourth panel upwardly such that the patient is moved to a generally upright sitting position.

In some embodiments, the apparatus includes first and second back support members for preventing a patient sitting in an upright position on the first panel from falling backwards. The first back support member is movably mounted to a side portion of the second panel and is movable between a stored position and an operative position in a substantially transverse relationship with the second panel. The second back support panel is movably mounted to a side portion of the fourth panel and is movable between a stored position and an operative position in a substantially transverse relationship with the fourth panel. The first and second back support members are each movable via a respective manual actuator attached to the second and fourth panels. However, in some embodiments, the first and second back support members may be movable via actuators.

In some embodiments, the first panel includes an opening formed therein that is configured to receive and/or support a bed pan or portable toilet device. As such, a patient in an upright sitting position may perform toilet functions via the bedpan or toilet device. In other embodiments, the apparatus may be rolled or otherwise moved into position above a toilet in a restroom to allow the patient sitting thereon to perform toilet functions.

The first, second and fourth panels may have various shapes and configurations. In some embodiments, the first panel has a length that is greater than a length of each of the second and fourth panels. In some embodiments, the second and fourth panels have substantially equal lengths.

The first, second, third and fourth panels may be formed of various materials including, but not limited to, one or more of the following: aluminum, stainless steel, carbon steel, mesh material, quilted material, and mattress ticking material.

In some embodiments, the base is a portable base comprising a plurality of wheels or casters that allow the apparatus to be moved about a room or facility.

According to other embodiments of the present invention, actuators (e.g., electric, hydraulic, or pneumatic actuators, etc.) are utilized to operate the second and fourth panels to move a patient to a generally upright sitting position. For example, in some embodiments, a first actuator is pivotably secured to a support member that extends (e.g., downwardly) from the first panel. The first actuator includes an extendable and retractable element that is connected to the second panel. When the element of the first actuator is fully retracted the second panel is substantially co-planar with the first panel, and when the element of the first actuator is fully extended the second panel is substantially orthogonal with the first panel. Thus, when a patient is positioned on the patient support platform such that the patient's upper body is supported by the first and second panels and the patient's legs are supported by the third panel, extension of the first actuator element causes the second panel to pivot upwardly such that the patient is moved to a generally upright sitting position.

Similarly, a second actuator is pivotably secured to a support member that extends (e.g., downwardly) from the first panel. The second actuator includes an extendable and retractable element that is connected to the fourth panel. When the element of the second actuator is fully retracted the fourth panel is substantially co-planar with the first panel, and when the element of the second actuator is fully extended the fourth panel is substantially orthogonal with the first panel. The fourth panel can be moved to be substantially orthogonal with the first panel at substantially the same time that a patient is being moved to an upright sitting position via the second panel, or subsequently thereafter.

When the third panel is removably secured to the fourth panel, and a patient is positioned on the support platform such that the patient's upper body is supported by the first and fourth panels and the patient's legs are supported by the third panel, the second actuator is configured to pivot the fourth panel upwardly such that the patient is moved to a generally upright sitting position.

A control system or unit with user controls is provided that operates the lifting mechanism to move the patient support platform between raised and lowered positions. The control system or unit also operates the first and second actuators to cause the second and fourth panels, respectively, to pivot upwardly.

According to embodiments of the present invention, a method of moving a patient between a reclining position on a bed and a generally upright sitting position via an apparatus is provided. The apparatus includes a patient support platform having a first panel comprising opposite first and second ends, a second panel movably attached to the first panel first end and upwardly pivotable from a substantially co-planar relationship with the first panel to a substantially orthogonal relationship with the first panel, and a third panel secured to the second panel in spaced-apart, substantially co-planar relationship therewith. The patient support platform is positioned in adjacent, overlying relationship with a bed upon which the patient is lying on. The patient is then moved onto the patient support platform such that the patient's upper body is supported by the first and second panels and the patient's legs are supported by the third panel. The second panel is then caused to pivot upwardly, thereby moving the patient to a generally upright sitting position.

In some embodiments, causing the second panel to pivot upwardly includes allowing the weight of the patient's legs on the third panel to move the third panel under the force of gravity and pivot the second panel upwardly. In other embodiments, causing the second panel to pivot upwardly comprises controlling an actuator to pivot the second panel upwardly.

In some embodiments, the patient support platform includes a fourth panel that is movably attached to the first panel second end and that is upwardly pivotable from a substantially co-planar relationship with the first panel to a substantially orthogonal relationship with the first panel. The method can further include moving the fourth panel to the substantially orthogonal relationship with the first panel at substantially the same time or subsequent to causing the second panel to pivot upwardly.

The first, second, third and fourth panels may be formed of various materials including, but not limited to, one or more of the following: aluminum, stainless steel, carbon steel, mesh material, quilted material, and mattress ticking material.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

FIG. 1 illustrates a patient support platform of the apparatus in a raised configuration and FIG. 2 illustrates the patient support platform in a lowered configuration.

DETAILED DESCRIPTION

Figure 1:
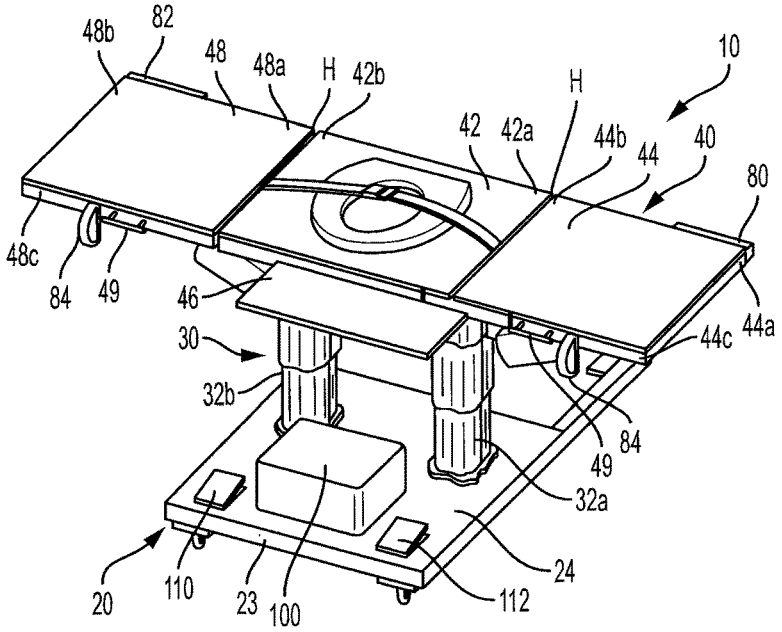
FIGS. 1 and 2 are top perspective views of an apparatus for moving a patient between a reclining position and a generally upright sitting position, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second, and the like, are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary more or less, for example by +/−20%, +/−10%, +/−5%, +/−1%, +/−0.5%, +/−0.1%, etc.

The term "substantially orthogonal", as used herein, means perpendicular +/−15%.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Referring now to FIGS. 1-14, 17 and 18, a portable apparatus 10 for moving a patient between a reclining position on a bed and a generally upright sitting position, according to some embodiments of the present invention, is illustrated. The apparatus 10 includes a base 20, a lifting mechanism 30 secured to the base 20, and an articulating patient support platform 40 secured to the lifting mechanism 30.

Figure 2:
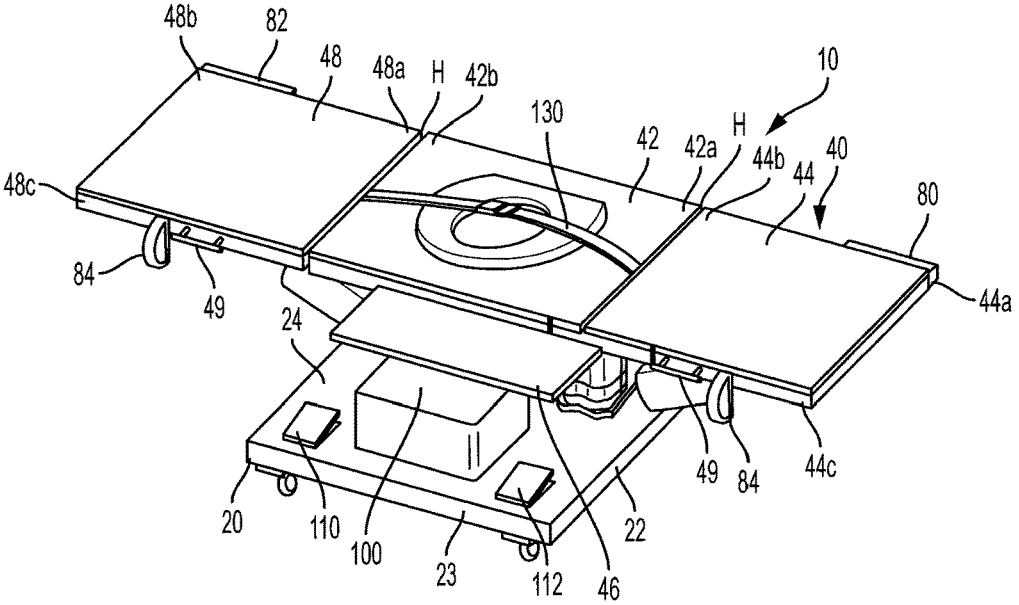

As shown in FIGS. 1 and 2, for example, the illustrated base 20 includes a pair of elongated legs 22 in spaced-apart, generally parallel relationship and a plate member 24 that overlies and is secured to the legs 22 at one end portion thereof, as illustrated. Each leg 22 has opposite first and second ends 22*a*, 22*b* (FIG. 7), and a wheel or caster 25 is located near each respective leg first and second end 22*a*, 22*b*, as illustrated, so that the apparatus 10 can be moved about a room or facility. In some embodiments, one or more of the wheels/casters 25 is a locking wheel/caster that can be selectively locked to prevent movement of the apparatus 10. In some embodiments, a step locking bar can be provided to lock both front wheels 25 or both back wheels 25. In the illustrated embodiment, a cross member 23 extends between and is secured to the legs 22 at the respective first ends 22*a* thereof, as illustrated.

The base 20 may be formed from various materials, as would be understood by one skilled in the art. Exemplary materials may include, but are not limited to, aluminum, stainless steel, carbon steel, and the like.

The plate member 24 supports the lifting mechanism 30, the power supply 100 and the user control mechanisms 110, 112 for the apparatus 10. The lifting mechanism 30 and the patient support platform 40 are positioned on the plate member 24 closer to the first ends 22*a* of the elongated legs 22 such that the second ends 22*b* (FIG. 7) of the elongated legs can extend at least partially under a bed of a patient.

The illustrated lifting mechanism 30 includes a pair of spaced-apart vertically telescoping lift columns 32*a*, 32*b* supported by the plate member 24 of the base 20. Each telescoping lift column 32*a*, 32*b* is configured to move between an extended configuration (e.g., FIGS. 1 and 3) and a retracted configuration (FIGS. 2 and 5), thereby raising and lowering the patient support platform 40 relative to the base 20. The lifting mechanism 30 allows the patient support platform 40 to be raised relatively high relative to the base 20 and to be lowered relatively low with respect to the base 20. Exemplary lift columns that may be utilized for the telescoping lift columns 32*a*, 32*b* of the present invention are available, for example, from Thomson (203A West Rock Road, Radford, Va.) and utilize a telescoping lead screw mechanism powered by an electric motor (not shown). However, lift columns from various manufacturers may be utilized. Embodiments of the present invention are not limited to any particular manufacturer of lift columns. In addition, the telescoping lift columns 32*a*, 32*b* of the lifting mechanism 30 may be extended and retracted in various ways, without limitation. For example, each lift column 32*a*, 32*b* can be extended and retracted via hydraulic cylinders, air cylinders, electric motors such as servo motors, and/or various types of electromechanical devices, etc. Moreover, embodiments of the present invention are not limited to the use the illustrated telescoping lift columns 32*a*, 32*b*. Other embodiments of the present invention may utilize other types of lifting mechanisms, such as a scissors lift mechanism, a single lift column, etc., to raise and lower the patient support platform 40.

The telescoping lift columns 32*a*, 32*b* may be formed from various materials, as would be understood by one skilled in the art. Exemplary materials may include, but are not limited to, aluminum, stainless steel, carbon steel, and the like.

The illustrated articulating patient support platform 40 includes first, second, third and fourth panels 42, 44, 46, 48. In the illustrated embodiment, each of the first, second, third and fourth panels 42, 44, 46, 48 has a generally planar, rectangular configuration, although other shapes and configurations may be utilized. In the illustrated embodiment, the first panel 42 has a length $L_1$ (FIG. 7) that is greater than a length $L_2$, $L_3$ (FIG. 7) of the second and fourth panels 44, 48, respectively. Also, in the illustrated embodiment, the second and fourth panels 44, 48 have substantially equal lengths (i.e., $L_2=L_3$).

The patient support platform may be formed of various materials including, but not limited to, aluminum, stainless steel, carbon steel, etc., as would be understood by one skilled in the art. In some embodiments, one or more of the first, second, third and fourth panels 42, 44, 46, 48 may be formed of or comprise mesh material, quilted material, mattress ticking material, etc. In other embodiments, one or both of the second and fourth panels 44, 48 may include pillow-type pads or other cushioning material.

Figure 11:
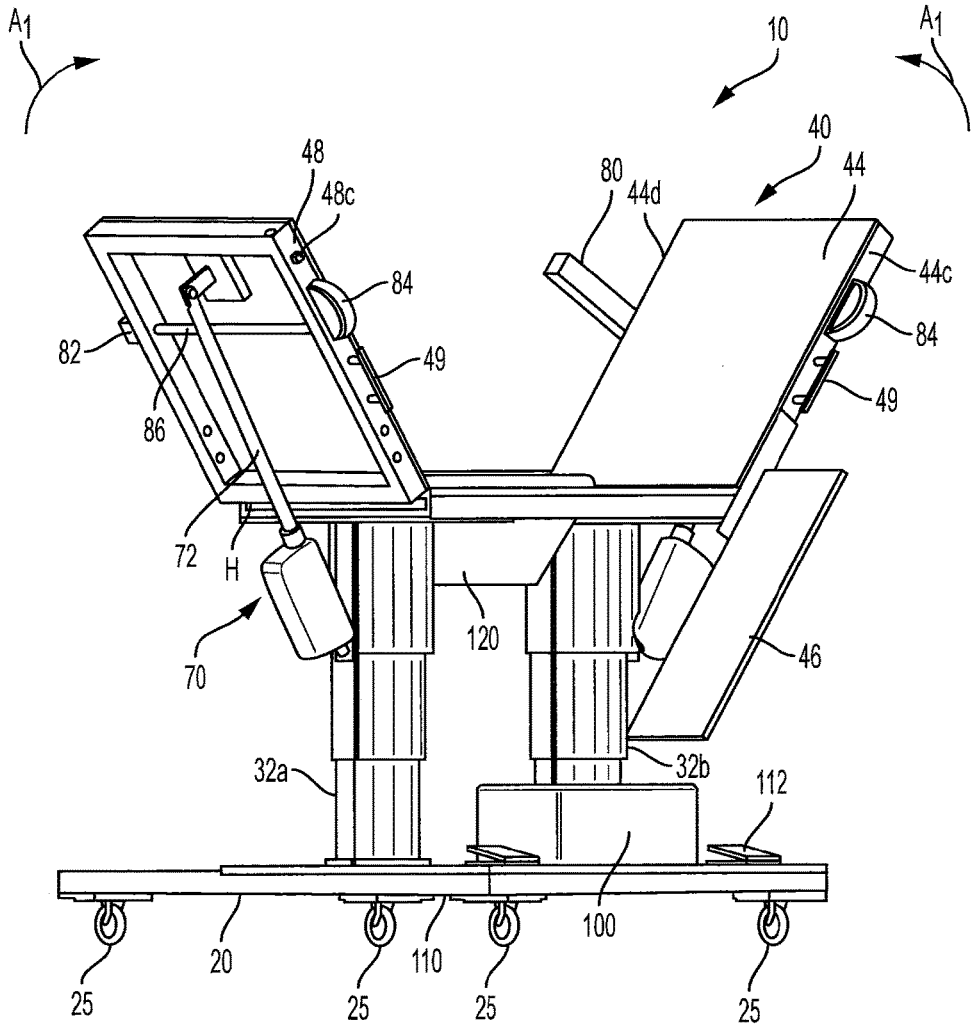
FIG. 11 is a front perspective view of the apparatus of FIG. 10.
Figure 12:
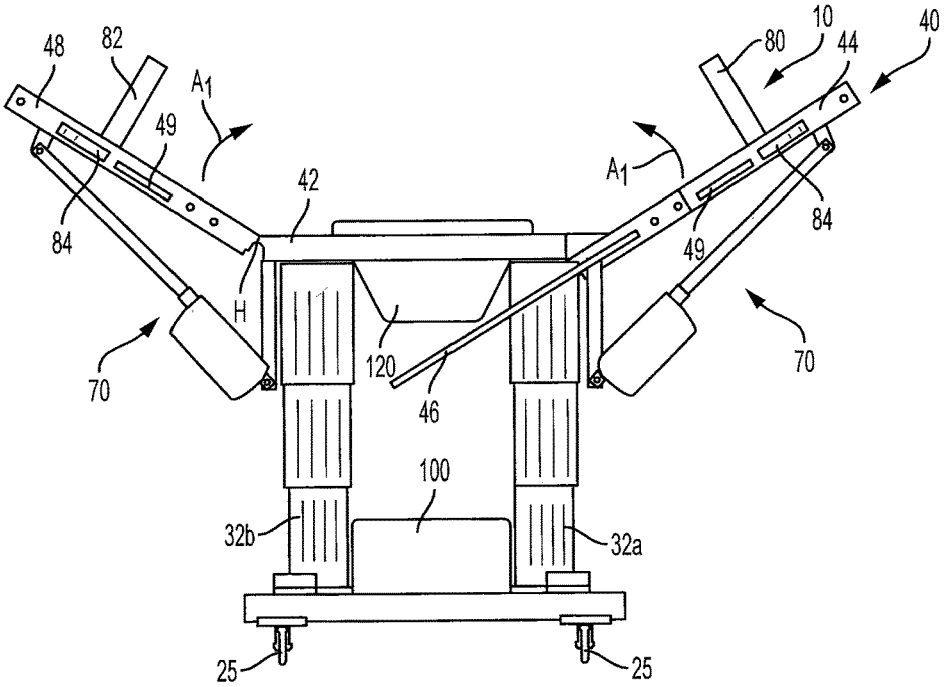
FIG. 12 is a front elevation view of the apparatus of FIG. 10.
Figure 13:
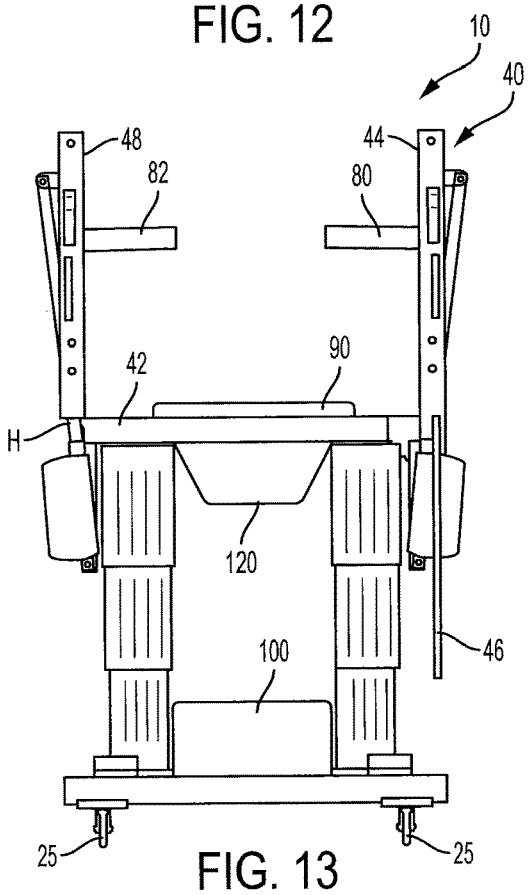
FIG. 13 is a front elevation view of the apparatus of FIG. 10 after the patient support platform has articulated such that the second and fourth panels are substantially orthogonal to the first panel.

The telescoping lift columns 32*a*, 32*b* of the lifting mechanism 30 are secured to the first (i.e., medial) panel 42, thereby allowing the second, third and fourth panels 44, 46, 48 to move relative to the first panel 42, as described below. The first panel 42 includes opposite first and second ends 42*a*, 42*b*, and the second panel 44 includes opposite first and second ends 44*a*, 44*b*. The second panel 44 is movably attached, for example via one or more hinges H, to the first panel first end 42*a* via the second panel second end 44*b*, as illustrated. Referring to FIGS. 11-13, the second panel 44 is upwardly pivotable (indicated by arrow $A_1$) from a substantially co-planar relationship with the first panel 44 (FIG. 3) to a substantially orthogonal relationship (FIG. 13) with the first panel 42.

Referring again to FIGS. 11-13, the fourth panel 48 includes opposite first and second ends 48*a*, 48*b*, and the fourth panel 48 is movably attached, for example via one or more hinges H, to the first panel second end 42*b* via the fourth panel first end 48*a*, as illustrated. The fourth panel 48 is upwardly pivotable (indicated by arrow $A_1$) from a substantially co-planar relationship with the first panel 44 (FIG. 3) to a substantially orthogonal relationship (FIG. 13) with the first panel 42.

Figure 7:
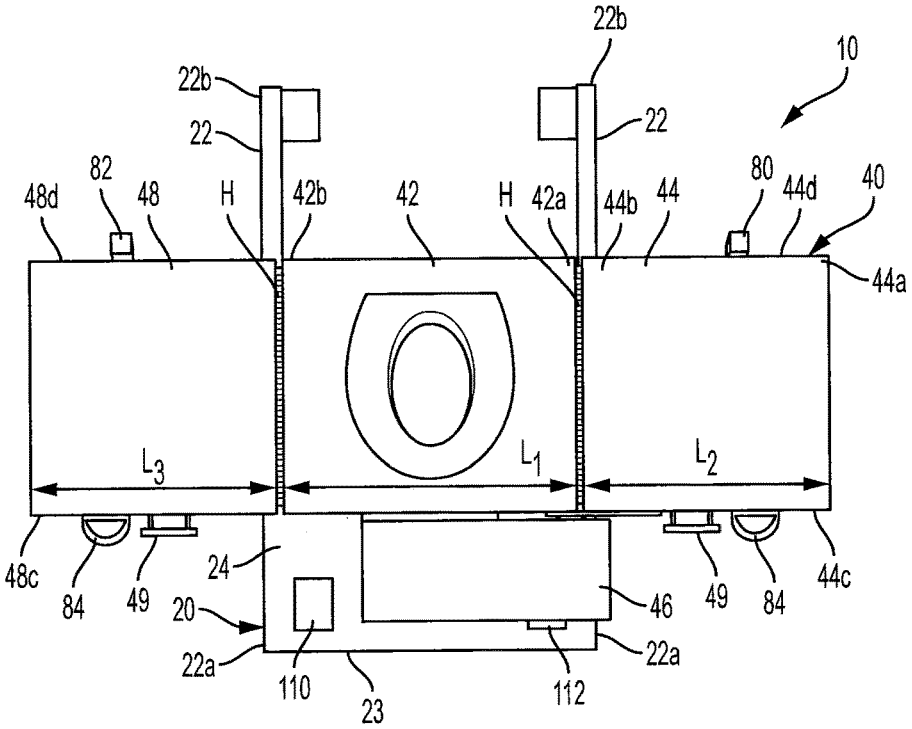
FIG. 7 is a top plan view of the apparatus of FIG. 6.
Figure 8:
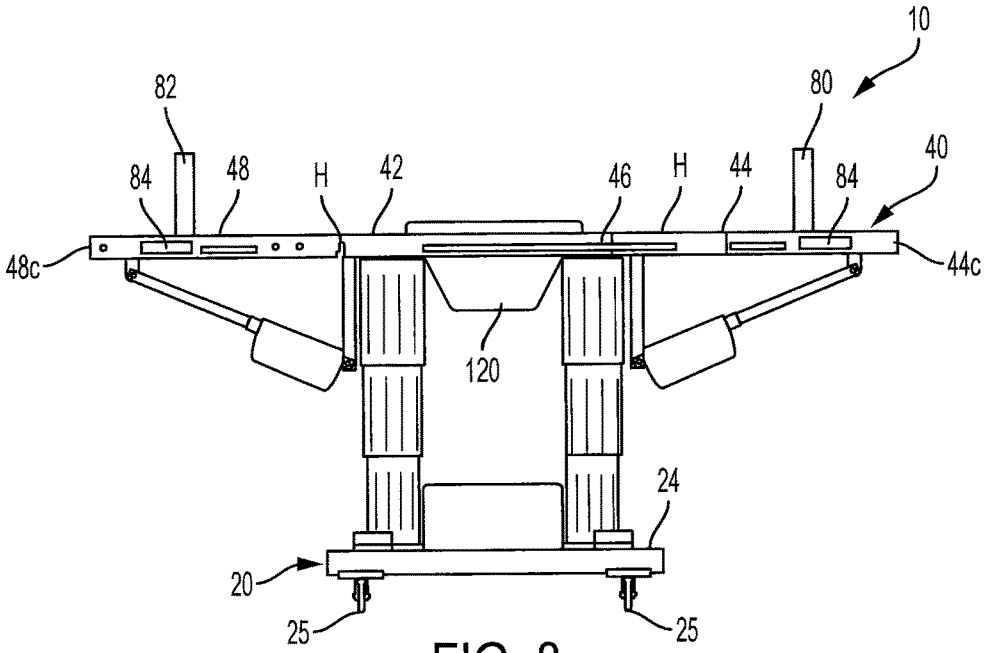
FIG. 8 is a front elevation view of the apparatus of FIG. 6.
Figure 9:
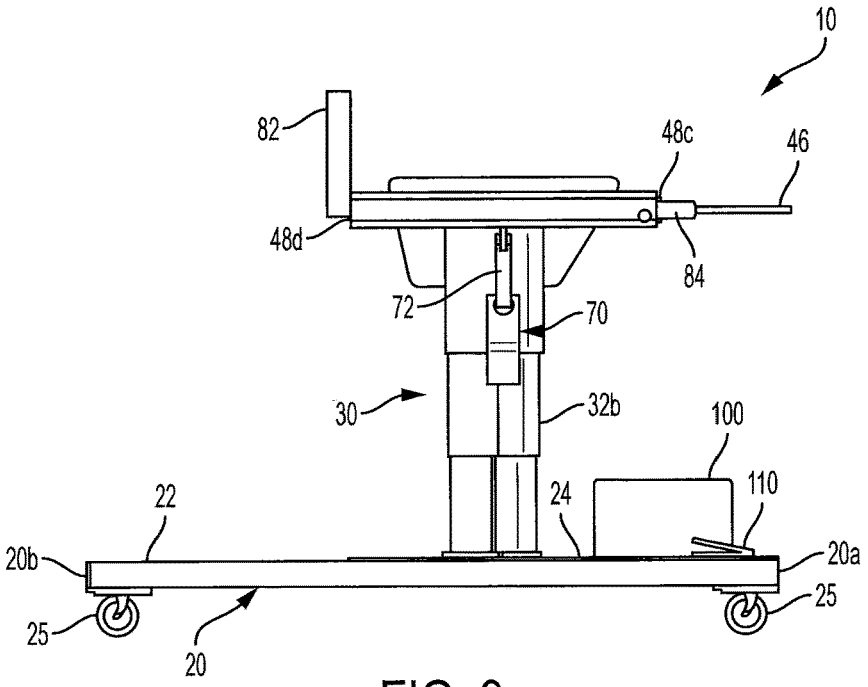
FIG. 9 is a side elevation view of the apparatus of FIG. 6.
Figure 10:
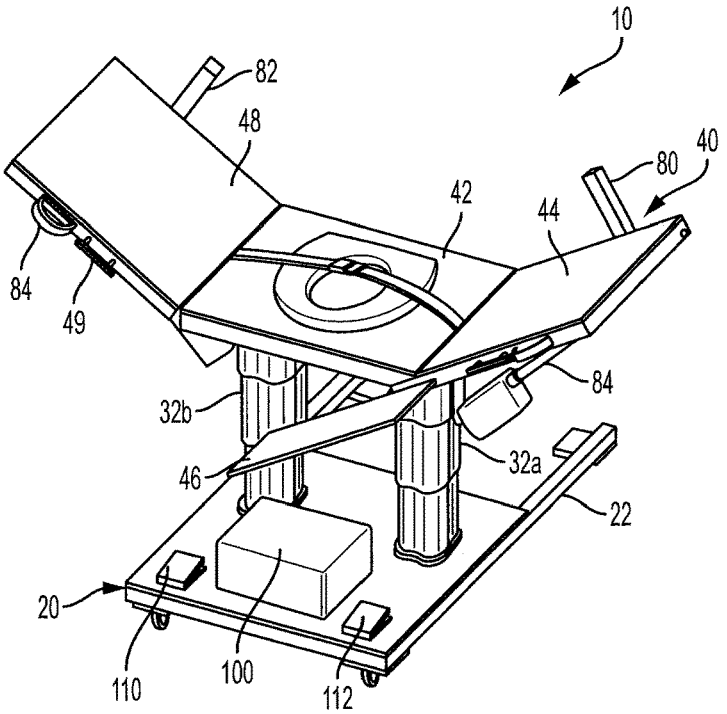
FIG. 10 is a top perspective view of the apparatus of FIG. 6 illustrating the patient support platform being articulated, according to some embodiments of the present invention.
Figure 15:
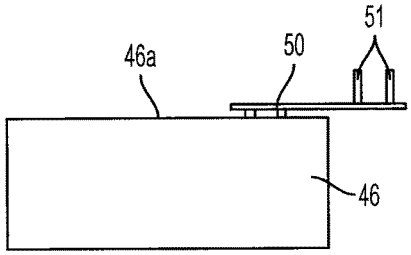
FIG. 15 is a top plan view of the third panel of the apparatus of FIG. 1.
Figure 16:
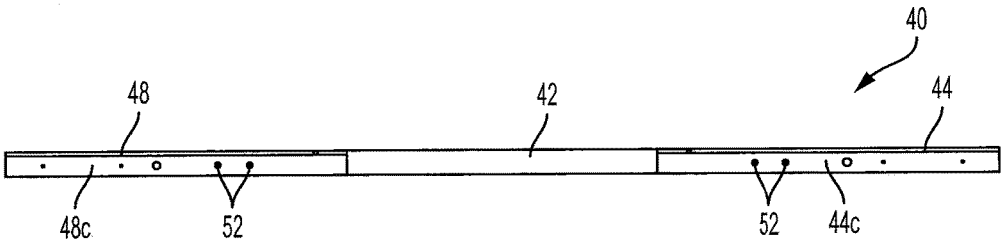
FIG. 16 is a front elevation view of the patient support platform of the apparatus of FIG. 1.

The third panel 46 is secured to the second panel 44 in spaced-apart, substantially co-planar relationship therewith, as illustrated in FIG. 7. Referring to FIGS. 7, 15 and 16, the third panel 46 and its connection to the second panel 44 is illustrated in more detail. The third panel 46 includes an elongated arm 50 that is attached to an edge portion 46*a* of the third panel 46. The elongated arm 50 includes a pair of rods or pins 51 that are configured to matably engage a pair of receiving bores 52 in an edge portion 44*c* of the second panel 44. In some embodiments, as illustrated in FIG. 16, the fourth panel 48 includes a pair of receiving bores 52 in an edge portion 48*c* thereof. The third panel 46 can be removed from the second panel 44 and secured to the fourth panel 48 by engaging the pair of pins 51 within the receiving bores 52 in the edge portion 48*c* of the fourth panel 48. The pins 51 can be removably retained with the receiving bores 52 via various types of retaining mechanisms, such as cotter pins, spring-loaded grips, etc.

Figure 3:
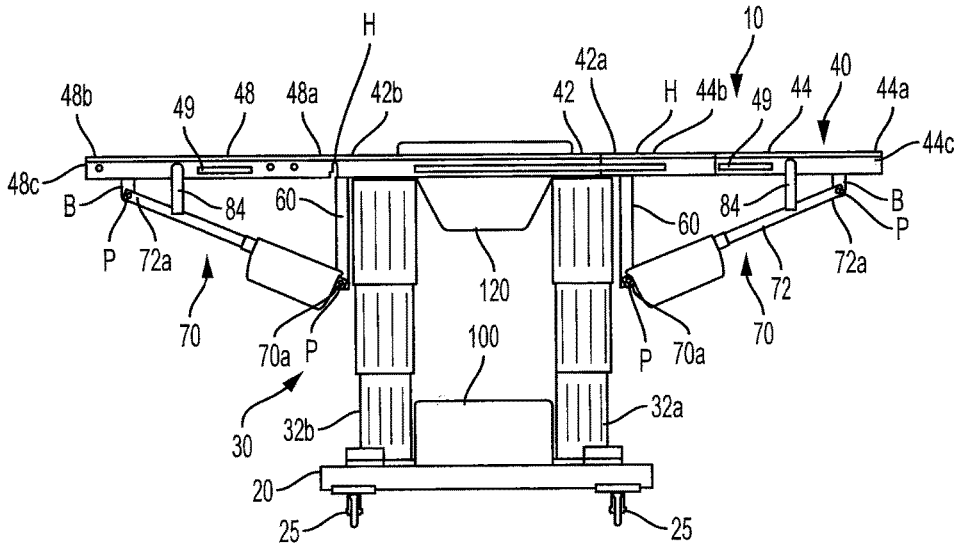
FIG. 3 is a front elevation view of the apparatus of FIG. 1.
Figure 4:
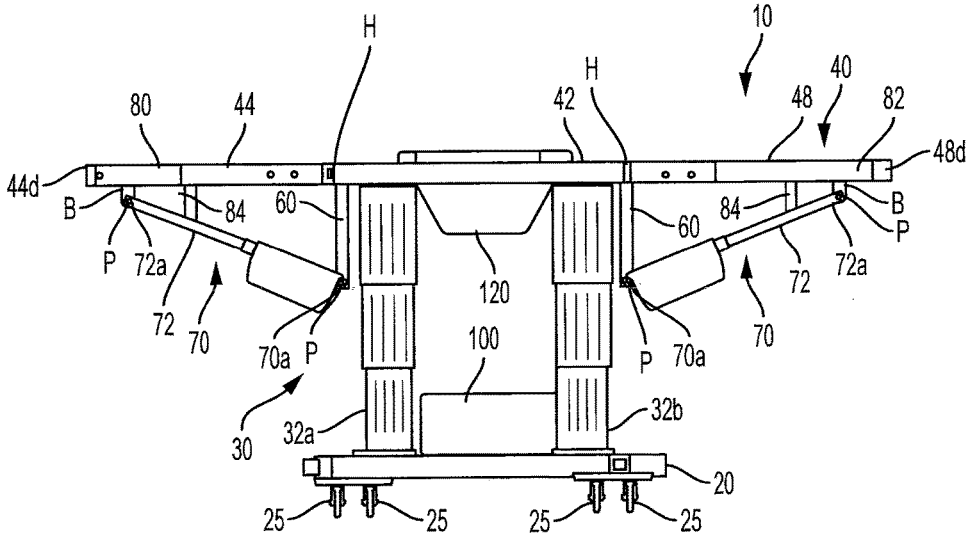
FIG. 4 is a rear elevation view of the apparatus of FIG. 1.
Figure 5:
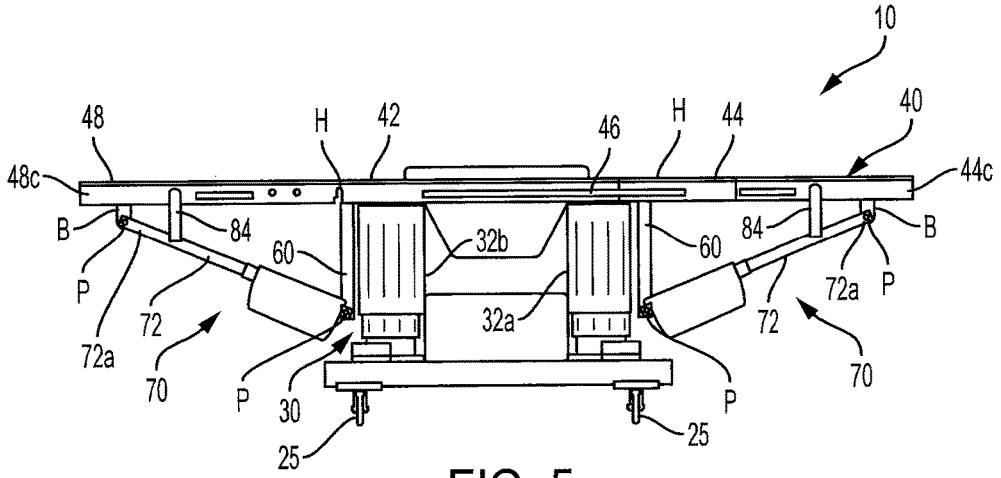
FIG. 5 is a front elevation view of the apparatus of FIG. 1 with the patient support platform in a lowered position.

Referring back to FIGS. 3 and 4, a support member 60 extends down from the first panel 42 adjacent the first end 42*a* thereof. A first actuator 70 has an end portion 70*a* pivotably secured to the support member 60, for example via a rod or pin P. The first actuator 70 includes an extendable and retractable element 72 that is pivotably connected to a bracket B on the second panel 44 via a distal end portion 72*a*, thereof, for example via a rod or pin P. When the extendible element 72 of the first actuator 70 is fully retracted the second panel 44 is substantially co-planar with the first panel 42, as illustrated in FIGS. 3-5. When the element 72 of the first actuator 70 is fully extended, the second panel 44 is substantially orthogonal with the first panel 42, as illustrated in FIG. 13.

Similarly, another support member 60 extends down from the first panel 42 adjacent the second end 42*b* thereof. A second actuator 70 has an end portion 70*a* pivotably secured to the support member 60, for example via a rod or pin P. The second actuator 70 includes an extendable and retractable element 72 that is pivotably connected to a bracket B on the fourth panel 48 via a distal end portion 72*a*, thereof, for example via a rod or pin P. When the extendible element 72 of the second actuator 70 is fully retracted the fourth panel 48 is substantially co-planar with the first panel 42, as illustrated in FIGS. 3-5. When the element 72 of the second actuator 70 is fully extended the second panel 48 is substantially orthogonal with the first panel 42, as illustrated in FIG. 12.

Figure 17:
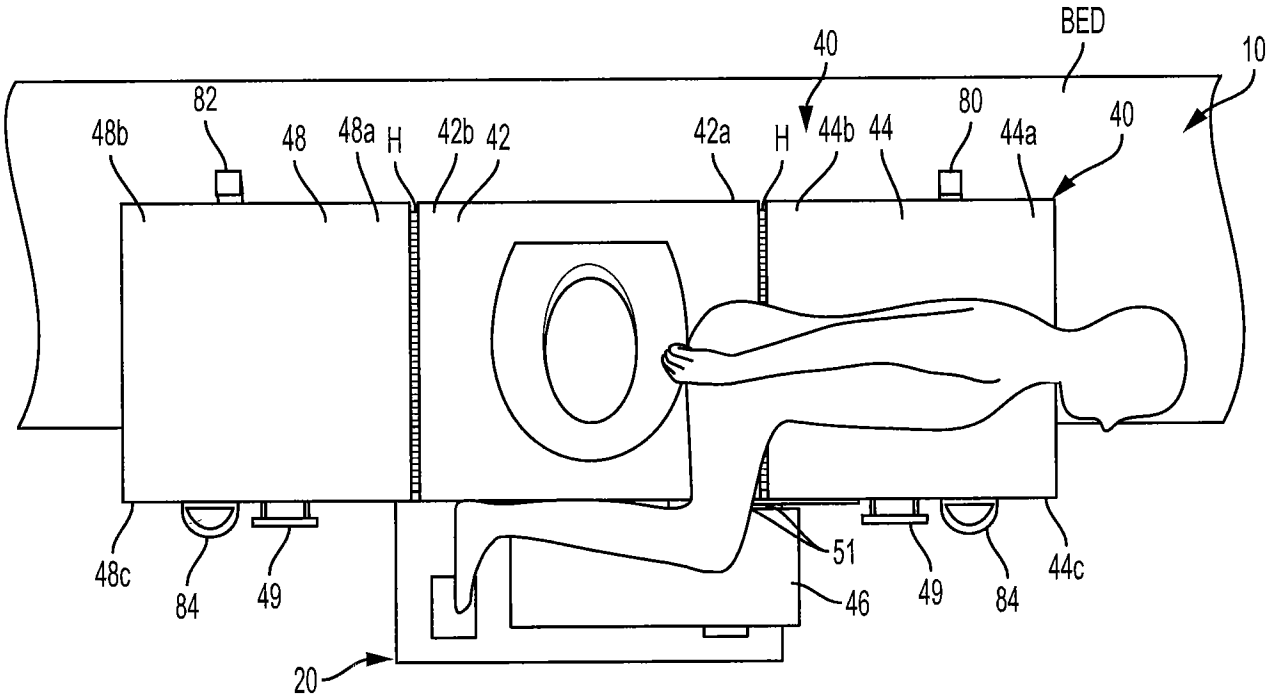
FIG. 17 is a top plan view of the apparatus of FIG. 1 and illustrating a patient positioned on the patient support surface such that the patient's upper body is supported by the first and second panels and the patient's legs below the knees are supported by the third panel.
Figure 18:
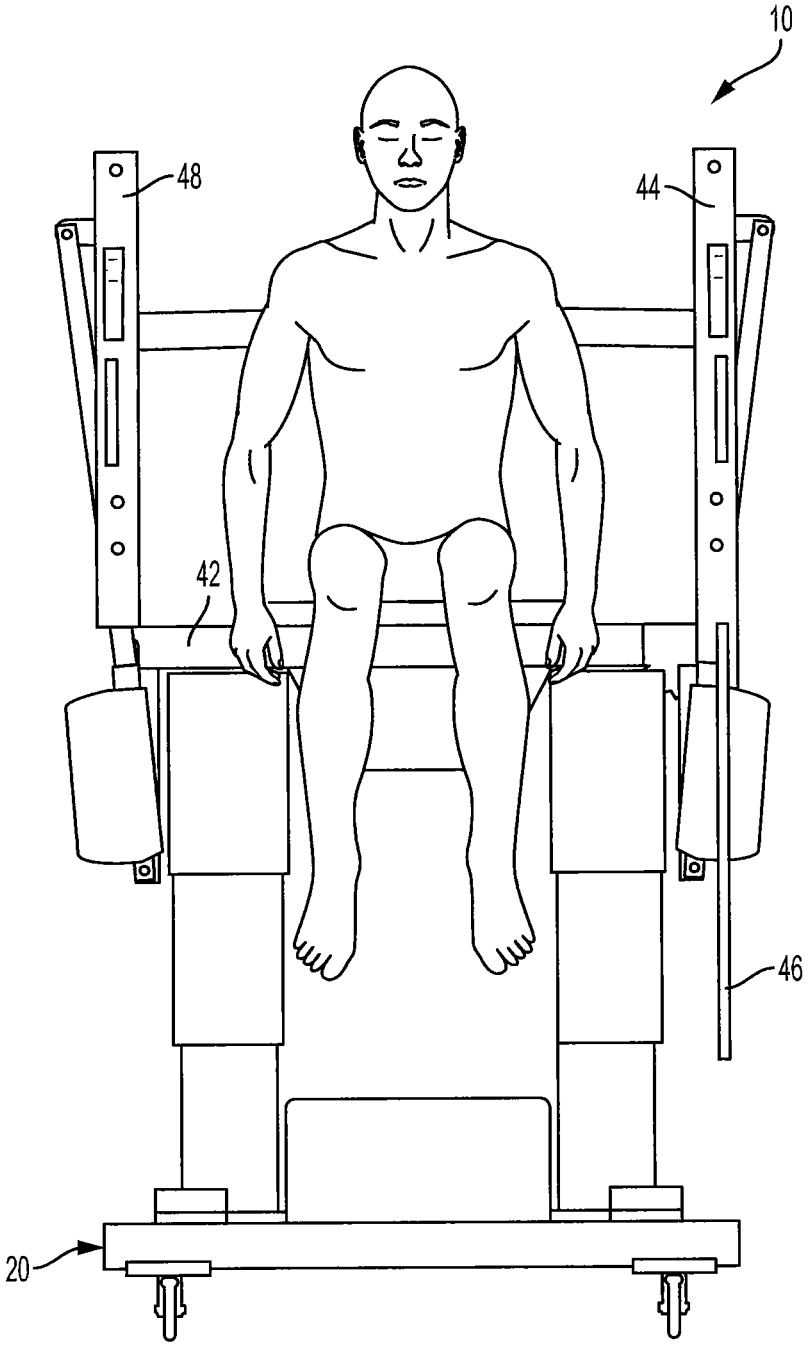
FIG. 18 is a front elevation view of the apparatus of FIG. 17 illustrating the patient in a generally upright sitting position.

The portable apparatus 10 is movable relative to a bed such that the patient support platform 40 can be positioned above a patient support surface of the bed (e.g., a mattress) and then lowered via the lifting mechanism 30 onto the bed. The patient support platform 40 is configured to be positioned such that a patient can be easily rolled or otherwise moved onto the patient support platform 40 from the bed. Prior to being moved onto the patient support platform 40, the patient is typically rolled onto his/her side. The apparatus 10 is then moved closer to the patient such that the patient support platform 40 is touching or very close to the patient. The patient is then rolled or otherwise moved onto the patient support platform 40 such that the patient is in a somewhat fetal position with the patient's upper body supported by the first and second panels 42, 44 and the patient's legs supported by the third panel 46, as illustrated in FIG. 17. The patient is then moved to an upright seated position (FIG. 18) by moving the second panel 44 upwardly via the first actuator 70 and which causes the patient's legs to move downwardly such that his/her feet are near the floor. The fourth panel 48 is moved to a substantially orthogonal relationship with the first panel 42 via the second actuator 70 at substantially the same time or subsequent to the second panel 44 being pivoted upwardly. In other embodiments, the fourth panel 48 can be moved to a substantially orthogonal relationship with the first panel 42 via the second actuator 70 prior to the second panel 44 being pivoted upwardly.

In some embodiments of the apparatus 10, an actuator is not utilized to move the second (or fourth) panel upwardly so as to move a patient to an upright, seated position. Rather, the weight of the legs of the patient under the force of gravity creates sufficient force downwardly on the third panel 46 so as to pivot the second panel 44 upwardly, thereby moving the patient to a seated position.

Figure 6:
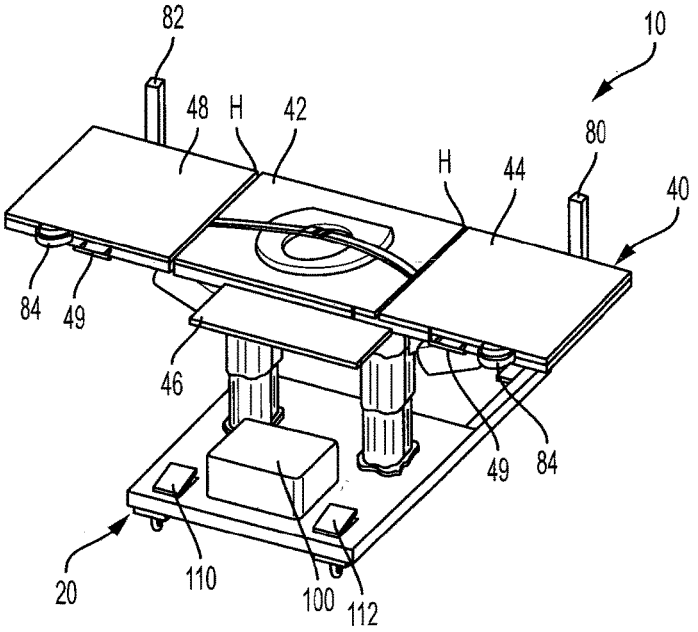
FIG. 6 illustrates the apparatus of FIG. 1 with back support members in operative positions, according to some embodiments.

As shown in FIGS. 6 and 7, the apparatus 10 can also include first and second back support members 80, 82. The first back support member 80 is movably mounted to a side portion 44*d* of the second panel 44 and is movable between a stored position (FIGS. 1 and 2) and an operative position (FIG. 6) in a substantially transverse relationship with the second panel 44. The second back support member 82 is movably mounted to a side portion 48*d* of the fourth panel 48 and is movable between a stored position (FIGS. 1 and 2) and an operative position (FIG. 6) in a substantially transverse relationship with the fourth panel 48.

The back support members 80, 82 may be formed of various materials including, but not limited to, aluminum, stainless steel, carbon steel, etc., as would be understood by one skilled in the art. The back support members 80, 82 may including padding (not illustrated) and may have various shapes and configurations. Embodiments of the present invention are not limited to the illustrated configuration of the back support members 80, 82, which are optional.

Each of the back support members 80, 82 may be manually operated via a respective handle 84 located on respective side portions 44*c* and 48*c* of the second and fourth panels 44, 48. Each handle 84 is connected to a respective back support member 80, 82 via an elongated rod 86 (FIG. 11) that extends between the side portions 44*c*, 44*d* of the second panel 44 and between the side portions 48*c*, 48*d* of the fourth panel 48. The elongated rod 86 is rotatable about its longitudinal axis such that rotation of each handle 84 causes corresponding rotation of a respective back support member 80, 82. As illustrated in FIG. 13, when the second and fourth panels 44, 48 are in an upright orientation, the back support members 80, 82 extend toward each other and are substantially horizontal and can provide protection against a patient falling backwards.

In the illustrated embodiment, the apparatus 10 also includes a pair of handles 49 secured to the patient support platform that can facilitate moving and positioning the apparatus 10 during use. One handle 49 is secured to edge portion 48*c* of the fourth panel 48 and another handle 49 is secured to edge portion 44*c* of the second panel 44. Various numbers and configurations of handles may be utilized without limitation.

The illustrated apparatus 10 includes an opening 90 in the first panel 42. A bed pan or portable toilet device 120 can be inserted within and supported by the opening 90 such that a patient in an upright sitting position may perform toilet functions. In some embodiments, padding (not shown) may be added around the opening 90 and/or around a bed pan or portable toilet device 120 inserted within the opening 90. Alternatively, or in addition, the opening 90 may be sized such that the apparatus 10 can be positioned and lowered over a toilet in a bathroom such that a patient sitting on the first panel can use the toilet.

In some embodiments, padding (not shown) may be provided around the toilet device 120. In other embodiments, a toilet device 120 is not inserted within the opening 90. Instead, a pad covers the opening 90 and is removed when access to the opening 90 is needed. As such, the apparatus 10 can be used to move a person to a seated position without necessarily requiring use of a toilet or a toilet device 120 inserted within the opening 90.

As discussed above, each lift column 32*a*, 32*b* can be operated by a linear actuator that is powered by an electric motor (not shown). A power supply 100 (e.g., one or more batteries, such as 12 volt 20 amp hour sealed batteries) is located on the base 20 and is configured to provide power to the electric motors for raising and lowering the lift columns 32*a*, 32*b* and is configured to provide power to the first and second actuators 70. In some embodiments, the power supply 100 includes a battery charger with a retractable power cord.

Control mechanisms 110, 112 can be provided on the base 20 and are configured to be operated by the foot of a user. Control mechanism 110 is configured to control operation of the lifting mechanism 30. In some embodiments, the control mechanism 110 is a synchronous control to ensure that the lift columns 32*a*, 32*b* are actuated synchronously. An exemplary synchronous control mechanism is the DCG24-2U-0280—LC2000/3000 control unit available from Thomson. However, control mechanisms from various manufacturers may be utilized. Embodiments of the present invention are not limited to any particular manufacturer of control mechanisms. Control mechanism 112 is configured to operate the first actuator 70 to cause the second panel 44 to pivot upwardly such that the patient is moved to a generally upright sitting position. Control mechanism 112 can also be utilized to operate the second actuator 70 to cause the fourth panel 48 to pivot upwardly to the substantially orthogonal relationship with the first panel 42. Exemplary control mechanisms suitable for use as control mechanism 112 are available from Thomson, as well as other manufacturers.

The illustrated apparatus 10 may include a seatbelt 130 or other restraining/safety device, as illustrated in FIG. 1. The seatbelt/restraining apparatus 130 is configured to be fitted around a patient after the patient is moved to an upright sitting position, as would be understood by one skilled in the art.

Figure 14A:
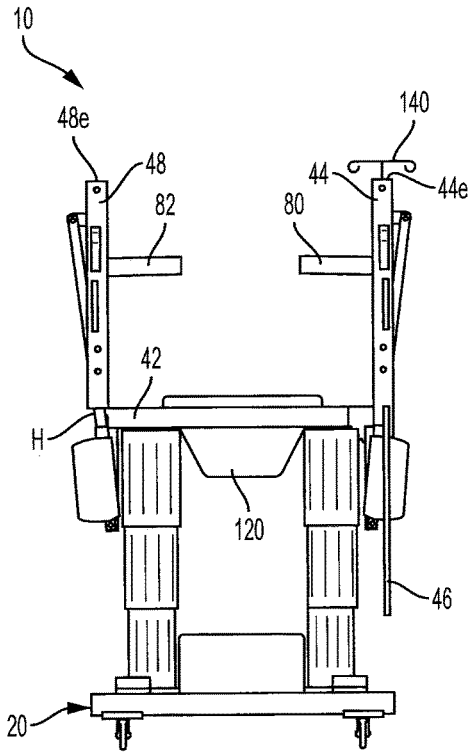
FIGS. 14A and 14B illustrate the apparatus of FIG. 13 with an IV pole supported by the second panel thereof and wherein the IV pole is in a retracted position (FIG. 14A) and an extended position (FIG. 14B).
Figure 14B:
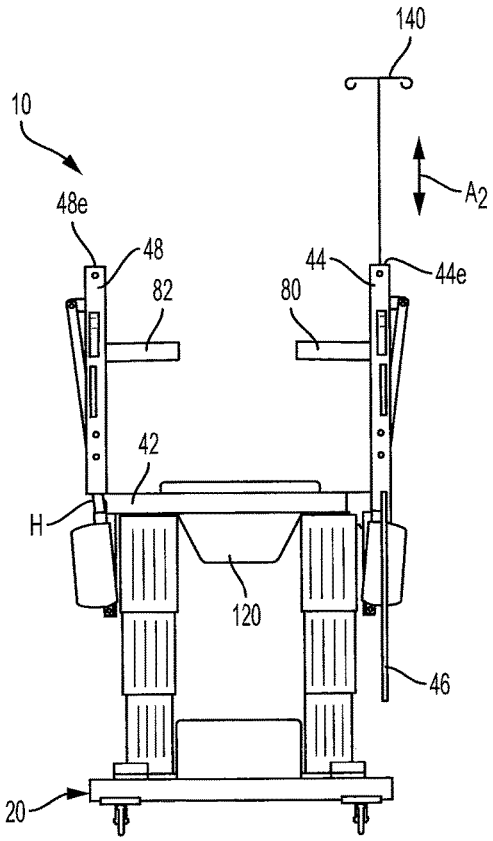

In some embodiments, and as illustrated in FIGS. 14A-14B, an IV pole 140 may be secured to an end portion 44*e* of the second panel 44. An IV pole 140 may also be secured to an end portion 48*e* of the fourth panel. In the illustrated embodiment, the IV pole 140 can be raised and lowered, as indicated by arrow $A_2$.

In some embodiments, the apparatus 10 may be motorized for movement about a room or facility, and such movement may be controlled via a remote control device (e.g., a wired or wireless remote control device). In such embodiments, one or more of the wheels/casters 25 may be driven by one or more motors. In other embodiments, one or more additional wheels may be provided that are driven by one or more motors. In some embodiments, an application ("app") operating on a smartphone or other computing device may be utilized as a remote control device for controlling operation and/or movement of the apparatus 10.

In some embodiments, the apparatus 10 may be configured to be attached directly to a bed or other furniture on which a patient may be reclining on. In such embodiments, the apparatus 10 may not need the base 20 or lifting mechanism 30. Rather, in some embodiments, the articulating patient support platform 40 would be attached directly to a bed or other furniture.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for moving a patient between a reclining position on a bed and a generally upright sitting position, the apparatus comprising:

a base;

a lifting mechanism secured to the base; and an articulating patient support platform secured to the lifting mechanism, wherein the patient support platform is movable via the lifting mechanism between raised and lowered generally horizontal positions, wherein the patient support platform comprises:

a first panel comprising opposite first and second ends;

a second panel movably attached to the first panel first end and upwardly pivotable from a substantially co-planar relationship with the first panel to a substantially orthogonal relationship with the first panel; and a third panel secured to the second panel in spaced-apart, substantially co-planar relationship therewith;

wherein the patient support platform is positionable on the bed such that a patient lying on the bed can be moved onto the patient support platform and positioned such that the patient's upper body is supported by the first and second panels and the patient's legs are supported by the third panel, and wherein the weight of the patient's legs on the third panel causes the third panel to move and pivot the second panel upwardly such that the patient is moved to a generally upright sitting position.

2. The apparatus of claim 1, wherein the first panel is secured to the lifting mechanism.

3. The apparatus of claim 1, further comprising a fourth panel movably attached to she first panel second end, and upwardly pivotable from a substantially co-planar relationship with the first panel to a substantially orthogonal relationship with the first panel.

4. The apparatus of claim 3, further comprising first and second back support members, wherein the first back support member is movably mounted to a side portion of the second panel and is movable between stored and operative positions, and wherein the second back support is movably mounted to a side portion of the fourth panel and is movable between stored and operative positions.

5. The apparatus of claim 4, wherein the first and second back support members are each movable via a respective manual actuator attached to the second and fourth panels.

6. The apparatus of claim 1, wherein the first panel comprises an opening formed therethrough such that the patient in the upright sitting position may perform toilet functions in conjunction with a bedpan or toilet.

7. The apparatus of claim 3, wherein the first panel has a length that is greater than a length of each of the second and fourth panels, and wherein the second and fourth panels have substantially equal lengths.

8. The apparatus of claim 1, wherein the base is a portable base comprising a plurality of wheels or casters.

9. The apparatus of claim 1, further comprising a control unit that directs the lifting mechanism to move the patient support platform between raised and lowered positions.

10. The apparatus of claim 1, wherein the lifting mechanism utilizes at least one of manual, electric, hydraulic, and pneumatic application of force.

11. The apparatus of claim 3, wherein the third panel is removable from the second panel and configured to be removably secured to the fourth panel, wherein the patient support platform is positionable on a bed such that a patient lying on the bed can be moved onto the patient support platform and positioned such that the patient's upper body is supported by the first and fourth panels and the patient's legs are supported by the third panel, and wherein the weight of the patient's legs on the third panel causes the third panel to move and pivot the fourth panel upwardly such that the patient is moved to a generally upright sitting position.

12. An apparatus for moving a patient between a reclining position on a bed and a generally upright sitting position, the apparatus comprising:

a base;

a lifting mechanism secured to the base; and an articulating patient support platform secured to the lifting mechanism, wherein the patient support platform is movable via the lifting mechanism between raised and lowered generally horizontal positions, wherein the patient support platform comprises:

a first panel comprising opposite first and second ends;

a second panel movably attached to the first panel first end and upwardly pivotable from a substantially co-planar relationship with the first panel to a substantially orthogonal relationship with the first panel;

a support member extending downwardly from the first panel;

a first actuator pivoted to the support member, wherein the first actuator comprises an extendable and retractable element connected to the second panel, wherein when the element of the first actuator is fully retracted the second panel is substantially co-planar with the first panel, and wherein when the element of the first actuator is fully extended the second panel is substantially orthogonal with the first panel; and a third panel laterally secured to the second panel in spaced-apart, substantially co-planar relationship therewith;

wherein the patient support platform is positionable on the bed such that a patient lying on the bed, can he moved onto the patient, support platform and positioned such that the patient's upper body is supported by the first and second panels and the patient's legs are supported by the third panel, and wherein extension of the first actuator element causes the second panel to pivot upwardly such that the patient is moved to a generally upright sitting position.

13. The apparatus of claim 12, wherein the first panel is secured to the lifting mechanism.

14. The apparatus of claim 12, further comprising:

a fourth panel movably, attached to the first panel second end and upwardly pivotable from a substantially co-planar relationship with the first panel to a substantially orthogonal relationship with the first panel;

a second support member extending downwardly from the first panel; and a second actuator pivoted to the second support member and comprising an extendable and retractable element connected to the fourth panel, wherein when the element of the second actuator is fully retracted the fourth panel is substantially co-planar with the first panel, and wherein when the element of the second actuator is fully extended the fourth panel is substantially orthogonal with the first panel.

15. The apparatus of claim 14, further comprising first and second back support members, wherein the first back support member is movably mounted to a side portion of the second panel and is movable between stored and operative positions, and Wherein the second back support member is movably mounted to a side portion of the fourth panel and is movable between stored and operative positions.

16. The apparatus of claim 15, wherein the first and second back support members are each movable via a respective manual actuator attached to the second and fourth panels.

17. The apparatus of claim 12, wherein the first panel comprises an opening formed therethrough such that the patient in the upright sitting position may perform toilet functions in conjunction with a bedpan or toilet.

18. The apparatus of claim 14, wherein the first panel has a length that is greater than a length of each of the second and fourth panels, and wherein the second and fourth panels have substantially equal lengths.

19. The apparatus of claim 12, wherein the base is a portable base comprising a plurality of wheels or casters.

20. The apparatus of claim 14, farther comprising a control unit, wherein the control unit operates the lifting mechanism to move the patient support platform between raised and lowered positions, wherein the control unit operates the first actuator to cause the second panel to pivot upwardly such that the patient is moved to a generally upright, sitting position, and wherein the control unit operates the second actuator to cause the fourth panel to pivot upwardly to the substantially orthogonal relationship with the first panel.

21. The apparatus of claim 12, wherein the lifting mechanism utilizes at least one of manual, electric, hydraulic, and pneumatic application of force, and wherein the first actuator is an. electric, hydraulic, or pneumatic, actuator.

22. A method of moving a patient between a reclining position on a bed and a generally upright sitting position, the method comprising:

positioning a patient support platform adjacent a bed, wherein the patient support platform comprises:

a first panel comprising opposite first and second ends;

a second panel movably attached to the first panel first end and upwardly pivotable from a substantially co-planar relationship with the first panel to a substantially orthogonal relationship with the first panel; and a third panel laterally secured to the second panel in spaced-apart, substantially co-planar relationship therewith;

moving a patient lying on the bed onto the patient support platform such that the patient's upper body is supported by the first and second panels and at least a lower length of the patient's legs are supported by the third panel; and causing the second panel to pivot upwardly, thereby moving the patient to a generally upright sitting position.

23. The method of claim 22, wherein causing the second panel to pivot upwardly comprises allowing the weight of the patient's legs on the third panel to move the third panel and pivot the second panel upwardly.

24. The method of claim 22, wherein causing the second panel to pivot upwardly comprises controlling an actuator to pivot the second panel upwardly.

25. The method of claim 22, wherein the patient support platform comprises a fourth panel movably attached to the first panel second end and upwardly pivotable from a substantially co-planar relationship with the first panel to a substantially orthogonal relationship with the first panel, and wherein the method further comprises moving the fourth panel to the substantially orthogonal relationship with the first panel at substantially the same time or subsequent to causing, the second panel to pivot upwardly.

26. The method of Claim 22, wherein positioning a patient support platform adjacent the bed comprises positioning the patient support platform in overlying relationship with the bed.

* * * * *